US007241109B2

(12) United States Patent
Ferra

(10) Patent No.: US 7,241,109 B2
(45) Date of Patent: Jul. 10, 2007

(54) SEAL SYSTEM

(75) Inventor: Paul William Ferra, Derby (GB)

(73) Assignee: Rolls-Royce PLC, London (GB)

( * ) Notice: Subject to any disclaimer, the term of this patent is extended or adjusted under 35 U.S.C. 154(b) by 18 days.

(21) Appl. No.: 11/121,928

(22) Filed: May 5, 2005

(65) Prior Publication Data

US 2005/0271504 A1 Dec. 8, 2005

(30) Foreign Application Priority Data

Jun. 4, 2004 (GB) ..... 0412476.4

(51) Int. Cl.
*F01D 11/02* (2006.01)

(52) U.S. Cl. ..... 415/174.5

(58) Field of Classification Search ..... 415/9, 415/109, 174.3, 174.4, 174.5, 230
See application file for complete search history.

(56) References Cited

U.S. PATENT DOCUMENTS

| | | | | |
|---|---|---|---|---|
| 3,549,270 | A | 12/1970 | Petrie et al. | |
| 4,447,190 | A * | 5/1984 | Campbell | 416/95 |
| 4,864,810 | A | 9/1989 | Hines | |
| 5,222,742 | A * | 6/1993 | Roberts | 277/420 |
| 2002/0028136 | A1 * | 3/2002 | Briesenick et al. | 415/116 |
| 2003/0012651 | A1 | 1/2003 | Arilla et al. | |
| 2003/0223893 | A1 | 12/2003 | Coulon et al. | |

FOREIGN PATENT DOCUMENTS

| | | |
|---|---|---|
| CA | 2 490 619 A1 | 1/2004 |
| EP | 0 919 700 A1 | 6/1999 |
| EP | 1 057 976 A1 | 12/2000 |
| EP | 1 471 211 A2 | 10/2004 |
| GB | 895467 | 5/1962 |
| GB | 2 111 598 A | 7/1983 |

* cited by examiner

*Primary Examiner*—Edward K. Look
*Assistant Examiner*—Nathan Wiehe
(74) *Attorney, Agent, or Firm*—Oliff & Berridge, PLC

(57) ABSTRACT

A seal system comprises a rotor and a stator. First and second cavities are defined between the rotor and the stator. A plurality of seals for inhibiting a flow of gas through the cavities are provided. Relative motion between the rotor and the stator can cause a flow of gas through the cavities via the seals. The. seals are arranged such that an increase in pressure in one of the first and second cavities is offset by a decrease in pressure in the other of the first and second cavities.

23 Claims, 3 Drawing Sheets

SEAL SYSTEM

This invention relates to seal systems. More particularly, but not exclusively, the invention relates to seal systems for use in gas turbine engines between a rotor and a stator.

In a gas turbine engine, where seals are arranged on a rotor, e.g. a turbine, to provide one or more cavities, the transient response of seal performance can result in fluctuations in pressure within the cavities and in the flows into and out of the cavities. This can result in additional cooling flow entering the gas path reducing engine efficiency and increasing gas path temperatures. This combined with fluctuations in the feed pressure and temperature to cooled turbine blades may result in reduced lives for turbine components. The fluctuations in pressure may also result in a transient increase in the axial load on the thrust bearing locating the engine shaft. This may cause the bearing to have a reduced life or increase its risk of failing.

According to one aspect of this invention, there is provided a seal system comprising a rotor and a stator, first and second cavities defined between the rotor and the stator, a plurality of seals for inhibiting a flow of gas through the cavities, wherein relative motion between the rotor and the stator can cause a flow of gas through the cavities via said seals, and the seals being arranged such that an increase in pressure in one of the first and second cavities is offset by a decrease in pressure in the other of the first and second cavities.

Preferably, the first cavity is upstream of the second cavity relative to said flow of gas. A third cavity may be defined between the rotor and the stator. Said third cavity may be upstream of the second cavity and downstream of the first cavity relative to said flow of gas.

The plurality of seals may comprise a first cavity inlet seal to provide an inlet to the first cavity during said flow of the gas. The plurality of seals may comprise a second cavity inlet seal to provide an inlet to the second cavity during said flow of the gas.

The plurality of seals may comprise a first cavity outlet seal to provide an outlet from the first cavity during said flow of the gas. The plurality of seals may provide a third cavity inlet seal to provide an inlet to the third cavity during said flow of the gas.

The plurality of seals may provide a second cavity inlet seal to provide an outlet from the third cavity during said flow of the gas.

Preferably, the first cavity outlet seal constitutes the third cavity inlet seal, whereby gas from the first cavity can pass from the first cavity directly into the third cavity.

Preferably the second cavity inlet seal constitutes the third cavity outlet seal, whereby gas from the third cavity can pass from the third cavity directly into the second cavity.

The plurality of seals may comprise a second cavity outlet seal to provide an outlet from the second cavity during said flow of the gas.

Preferably, each seal comprises a first part mounted on the stator, and a second part mounted on the rotor, the first and second parts being cooperable with each other to provide the respective seal.

The first part of the first cavity inlet seal may face inwardly and the second part of the first cavity inlet seal may face outwardly.

The first part of the second cavity inlet seal may face outwardly and the second part of the second cavity inlet seal may face inwardly.

The first part of the first cavity outlet seal may face outwardly, and the second part of the first cavity outlet seal may face inwardly.

The first part of the second cavity outlet seal may face inwardly, and the second part of the second cavity outlet seal may face outwardly.

Preferably, the first and second parts of the respective seals may face radially outwardly or radially inwardly, as appropriate.

The plurality of seals may comprise labyrinth seals, brush seals, carbon seals, foil seals, air riding seals, or any other seal whose performance is affected by the transient response of a rotor-stator arrangement in terms of axial or radial movements.

An embodiment of the invention will now be described by way of example only, with reference to the accompanying drawings, in which:—

Figure 1:
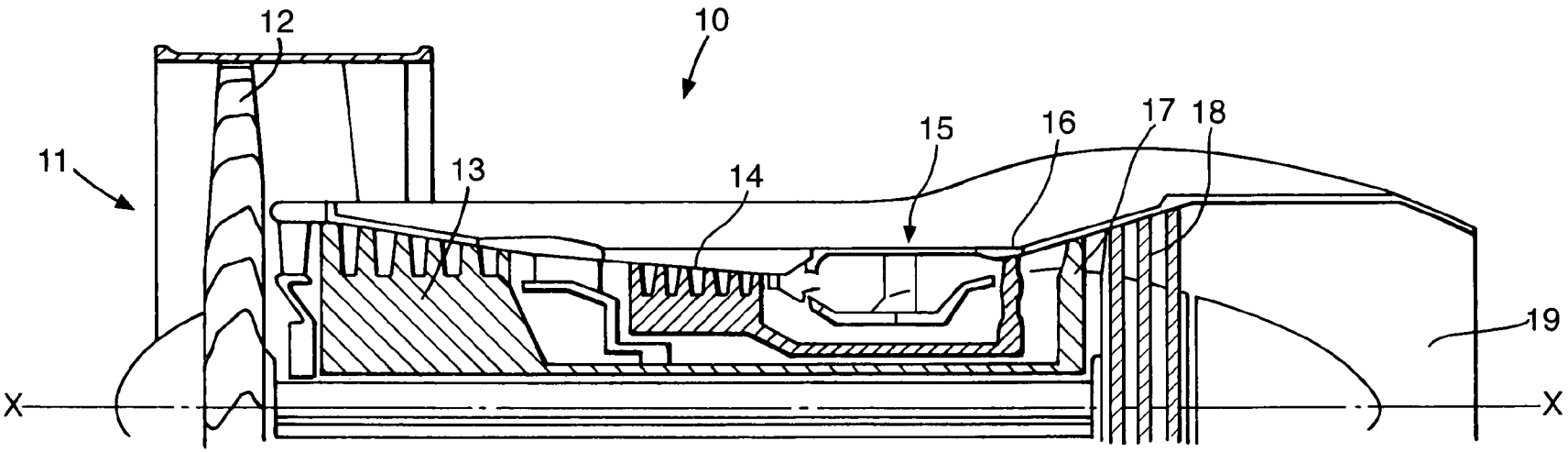
FIG. 1 is a sectional side view of the upper half of a gas turbine engine.

Referring to FIG. 1, a gas turbine engine is generally indicated at 10 and comprises, in axial flow series, an air intake 11, a propulsive fan 12, an intermediate pressure compressor 13, a high pressure compressor 14, combustion equipment 15, a high pressure turbine 16, an intermediate pressure turbine 17, a low pressure turbine 18 and an exhaust nozzle 19.

The gas turbine engine 10 works in a conventional manner so that air entering the intake 11 is accelerated by the fan 12 which produce two air flows: a first air flow into the intermediate pressure compressor 13 and a second air flow which provides propulsive thrust. The intermediate pressure compressor compresses the air flow directed into it before delivering that air to the high pressure compressor 14 where further compression takes place.

The compressed air exhausted from the high pressure compressor 14 is directed into the combustion equipment 15 where it is mixed with fuel and the mixture combusted. The resultant hot combustion products then expand through, and thereby drive, the high, intermediate and low pressure turbines 16, 17 and 18 before being exhausted through the nozzle 19 to provide additional propulsive thrust. The high, intermediate and low pressure turbine 16, 17 and 18 respectively drive the high and intermediate pressure compressors 14 and 13, and the fan 12 by suitable interconnecting shafts.

Figure 2:
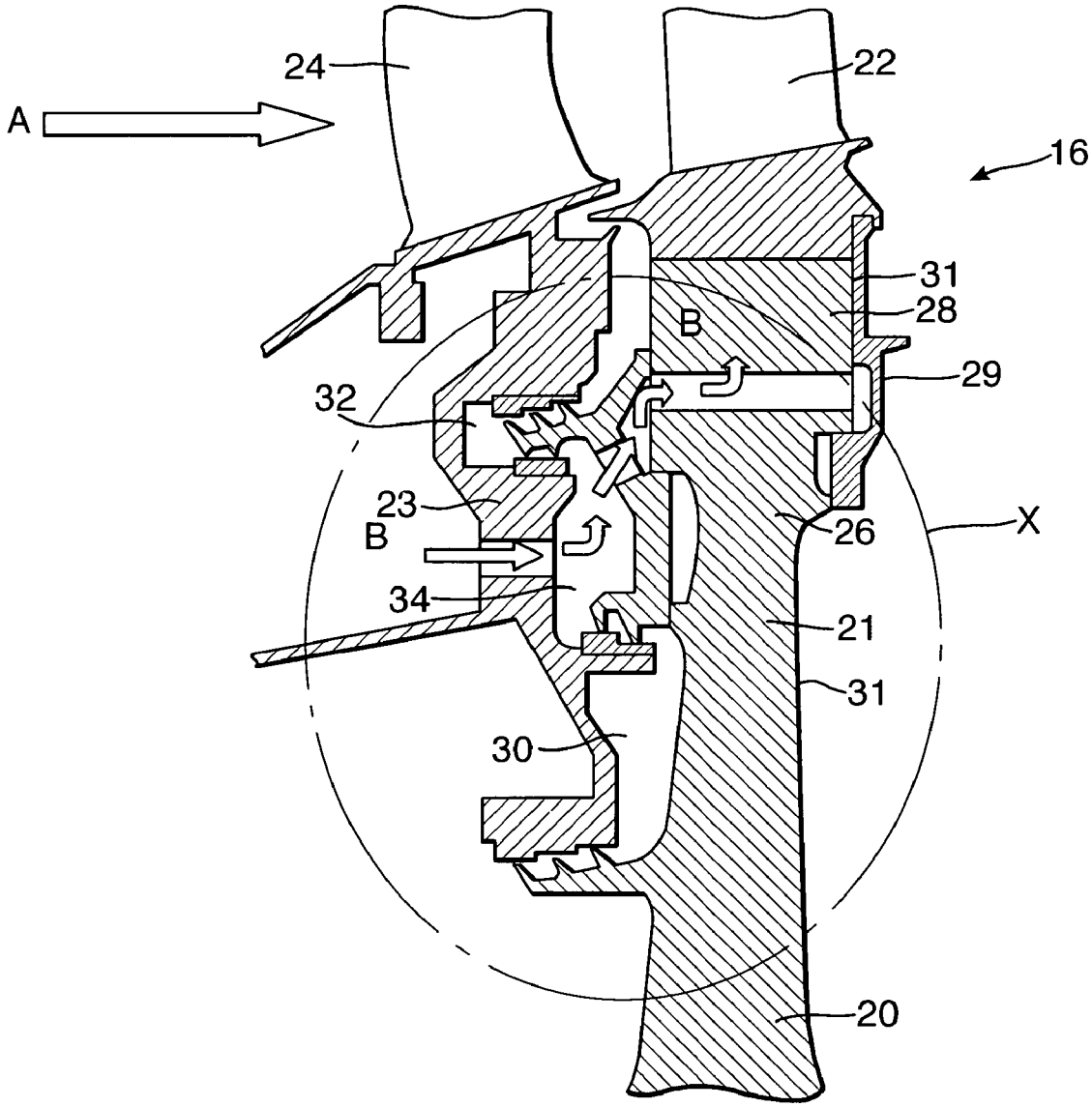
FIG. 2 is a sectional side view of an upper region of a turbine.

Referring to FIG. 2, there is shown in more detail an upper region of the high pressure turbine 16 of the engine 10 shown in FIG. 1. The high pressure turbine 16 comprises a rotary part or rotor 21 which comprises a disc 20 upon which a plurality of turbine blades 22 are mounted. The blades 22 are mounted one after the other circumferentially around the disc and each blade 22 extends radially outwardly from the disc 20. Air passes in the direction shown by the arrow A from the combustion equipment 15 onto nozzle guide vanes 24 from which the air is directed onto the turbine blades 22, causing the rotor 21 of the turbine 16 to rotate.

Figure 3:
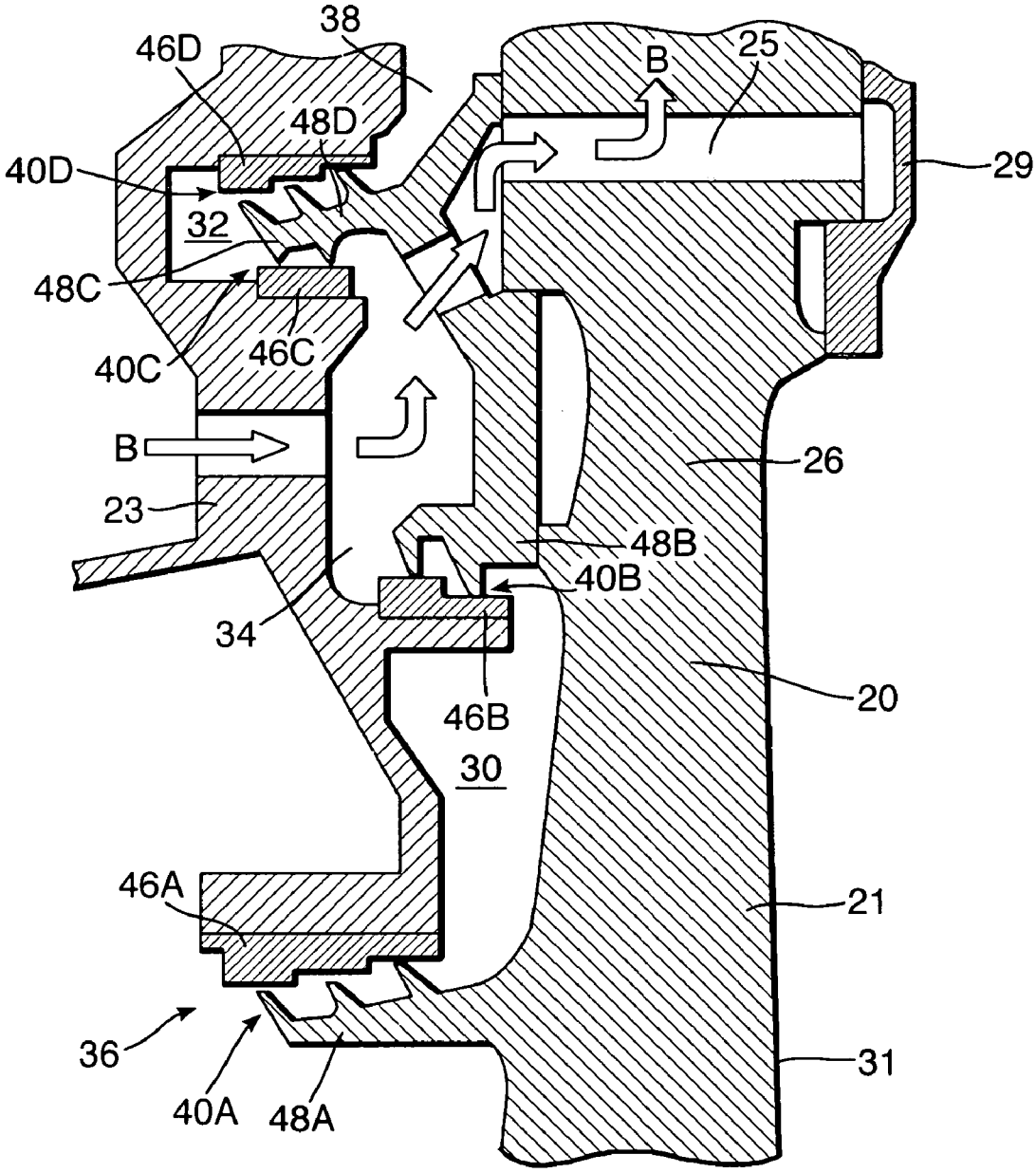
FIG. 3 is a close-up view of the region marked X in FIG. 2.

Radially inwards of the blades 22, the disc 20 comprises a main body 26 and a plurality of blade mounting members 28 extending radially outwardly from the main body 26. The blades 22 are slid between adjacent blade mounting members 28 and secured to the disc 20 by suitable securing means in the form of a circumferentially extending seal plate 29. The seal plate 29 is secured to the down stream face 31 of the disc 20 at the blade mounting members 28. In FIG. 2 a circle marked X designates a region of the rim of the disc 20 at which the blades 22 are secured to disc 20, and a detailed diagram of this region of the rim is shown in FIG. 3. Adjacent the disc 20, there is provided a stationary part of the engine, alternatively referred to as a stator 23.

Referring to FIG. 3, there is shown a detailed view of the region marked X in FIG. 2. The rotor 21 and the stator 23 define between them a first cavity 30, a second cavity 32, and a third cavity 34. The main flow of gas A (see FIG. 2) across the turbine blades 22 is at a high temperature and it is necessary to obtain a flow of cooling air into the blades 22 and other components to prevent a reduction in their service life. This flow of cooling air is indicated by the arrows B and as can be seen, the flow B of the cooling air passes through the third cavity 34. After entering a chamber 25 in the disc 20, the flow of cooling air B passes via conduits (not shown) to the blades 22 and other components that require cooling. In order to prevent air from flowing from a high pressure region 36 within the engine 10 to a low pressure region 38 and, thereafter into the main flow of air through the engine, a plurality of seals 40A to D are provided. The plurality of seals 40A to D comprises a first cavity inlet seal 40A, a first cavity outlet seal 40B, a second cavity inlet seal 40C and a second cavity outlet seal 40D.

Each of the seals 40A to D comprises a first part 46 on the stator 23 and a second part 48 on the rotor 21. The first and second parts 46, 48 of each seal 40A to D cooperate with each other to provide the desired sealing property.

During transient engine manoeuvres, for example a rapid acceleration of the engine during take off, the response from the seals 40A to D can cause a transient leakage of air across the seals and, thereby, detrimentally affect the pressures in the first and second cavities and the axial load on the shaft location bearing.

In order to mitigate the effects of such leakage, the first and second parts 46, 48 of the seals 40A to D are arranged as described below.

The first inlet seal 40A comprises a first part 46A on the stator 23, which faces radially inwardly, and a second part 48A on the rotor 21, which faces radially outwardly. The first cavity outlet seal 40B comprises a first part 46B on the stator 23, which faces radially outwardly, and a second part 48B on the rotor 21 which faces radially inwardly.

During a rapid acceleration of the rotor 21, the mechanical forces on the rotor 21 initially cause the first and second parts 46A, 48A to close. At the same time, the first and second parts of the first cavity outlet seal 46B and 48B open. This leads to a decrease in pressure within the first cavity 30.

As the rotor 21 and the stator 23 adjust to the higher temperatures of operation of the turbine 16, the first and second parts 46A and 48A of the first cavity inlet seal 40A open and the first and second parts 46B and 48B of the first cavity outlet seal 40B close. This leads to gradual increase in pressure within the first cavity 30.

Consequently, the combined effect of the two seals is that the flow into the third cavity remains unchanged.

The second cavity inlet seal 40C comprises a first part 46C on the stator 23, which faces radially outwardly, and a second part 48C on the rotor 21 which faces radially inwardly.

The second cavity outlet seal 40D comprises a first part 46D on the stator 23, which faces radially inwardly, and a second part 48D on the rotor 21, which faces radially outwardly.

During a rapid acceleration of the rotor 21, the mechanical forces on the rotor 21 initially cause the first and second parts 46C and 48C of the second cavity inlet seal 40C to open. At the same time, the first and second parts 46D and 48D of the second cavity outlet seal 40D close. This leads to an increase in pressure within the second cavity 32.

As the rotor 21 and the stator 23 adjust to the higher temperatures of operation of the turbine 16, the first and second parts 46C and 48C of the second cavity inlet seal 40C close and the first and second parts 46D and 48D of the second cavity outlet seal 40D open. This leads to a gradual decrease in pressure within the second cavity 32.

Consequently the combined effect of the two seals is that the flow out of the third cavity remains unchanged.

Thus, during acceleration of the engine, as the rotor 21 and the stator 23 adjusts to the high temperatures involved, the pressure in the first cavity 30 increases as the pressure in the second cavity 32 reduces. As changes in cavity pressures result in changes in the axial forces on the rotor 21. This provides the advantage in the preferred embodiment that high transient bearing load is reduced or eliminated.

There is no increase in the flow into or out of the third cavity 34. Thus, the pressure in the third cavity 34 remains unchanged and the amount of cooling air flow shown by the arrows B through the third cavity 34 to cool the blades remains largely unchanged. As there is also no change in flow out of the second cavity there is no change in flow into the main gas path to mix with the main flow of gas across the turbine 16. Thus increasing the turbine efficiency and therefore the potential turbine operating temperature. In this way, the service lives of turbine and bearing components are improved.

Various modifications can be made without departing from the scope of the invention, for example, the area ratio between the first cavity 30 and the second cavity 32 can be adjusted to ensure that the transient rotor axial load opposes the steady state load thus reducing bearing axial loads during certain regimes of engine operation, for example during take off. In addition, the seals can be labyrinth seals, brush seals, carbon seals, foil seals, air riding seals, or any other seal whose performance is affected by the transient response of a rotor-stator arrangement in terms of axial or radial movements.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A seal system comprising:

a rotor;

a stator;

first and second cavities defined between the rotor and the stator; and a plurality of seals for inhibiting a flow of gas through the cavities, wherein relative motion between the rotor and the stator causes the seals to open or close, one of the seals is arranged to open to increase the pressure in one of the first or second cavities and another seal is arranged to close to decrease the pressure in the other of the first or second cavities, wherein the plurality of seals includes a first cavity inlet seal, wherein each seal includes a first part and a second part, the first part being mounted on the stator and the second part being mounted on the rotor, wherein the first part of the first cavity inlet seal faces radially inwardly and the second part of the first cavity inlet seal faces radially outwardly.

2. A seal system according to claim 1 wherein the first cavity is upstream of the second cavity relative to said flow of gas.

3. A seal system according to claim 1 wherein a third cavity is defined between the rotor and the stator, the third cavity being upstream of the second cavity and downstream of the first cavity relative to said flow of gas.

4. A seal system according to claim 3 wherein a cooling airflow passes through the third cavity, from the stator to the rotor.

5. A seal system according to claim 4 wherein the cooling airflow remains largely unchanged.

6. A seal system according to claim 3 wherein the pressure in the third cavity remains unchanged.

7. A seal system according to claim 1 wherein the plurality of seals further comprises a second cavity inlet seal, the first cavity inlet seal provides an inlet to the first cavity during the flow of the gas, and the second cavity inlet seal provides an inlet to the second cavity during the flow of the gas.

8. A seal system according to claim 7 wherein the plurality of seals comprises a first cavity outlet seal to provide an outlet from the first cavity during said flow of the gas, and a second cavity outlet seal to provide an outlet from the second cavity during said flow of the gas.

9. A seal system according to claim 8 wherein the plurality of seals comprises a third cavity inlet seal to provide an inlet to the third cavity during said flow of the gas.

10. A seal system according to claim 8 wherein the first and second parts are co-operable with each other to provide the respective seal, the first part of the first cavity outlet seal faces radially outwardly, and the second part of the first cavity outlet seal faces radially inwardly.

11. A seal system according to claim 8 wherein the the first and second parts are co-operable with each other to provide the respective seal, the first part of the second cavity outlet seal faces radially inwardly, and the second part of the second cavity outlet seal faces radially outwardly.

12. A seal system according to claim 9 wherein the first cavity outlet seal constitutes the third cavity inlet seal, whereby gas from the first cavity can pass from the first cavity directly into the third cavity.

13. A seal system according to claim 7 wherein the plurality of seals provide a third cavity outlet seal to provide an outlet from the third cavity during said flow of the gas.

14. A seal system according to claim 13 wherein the second cavity inlet seal constitutes the third cavity outlet seal, whereby gas from the third cavity can pass from the third cavity directly into the second cavity.

15. A seal system according to claim 7 wherein the first and second parts are co-operable with each other to provide the respective seal.

16. A seal system according to claim 15 wherein the first part of the second cavity inlet seal faces radially outwardly and the second part of the second cavity inlet seal faces radially inwardly.

17. A gas turbine engine incorporating a turbine according to claim 15.

18. A turbine incorporating a seal system according to claim 1.

19. A seal system according to claim 1 wherein an area ratio between the first cavity and the second cavity ensures that transient rotor axial loads oppose steady state loads to reduce bearing axial loads during certain engine operations.

20. A seal system according to claim 1 wherein, during an acceleration of the rotor, one of the seals is arranged to open to allow the pressure to decrease in the one of the first or second cavities and another seal is arranged to open to allow the pressure to increase in the other of the first or second cavities.

21. A seal system according to claim 1 wherein, during an acceleration of the rotor, one of the seals is arranged to close to allow the pressure to decrease in the one of the first or second cavities and another seal is arranged to close to allow the pressure to increase in the other of the first or second cavities.

22. A seal system according to claim 1 wherein, after an acceleration of the rotor, one of the seals is arranged to close to allow the pressure to increase in the one of the first or second cavities and another seal is arranged to close thereby allowing pressure to decrease in the other of the first or second cavities.

23. A seal system according to claim 1 wherein, after an acceleration of the rotor, one of the seals is arranged to open to allow the pressure to increase in the first cavity and another seal is arranged to open to thereby to allow the pressure to decrease in the other of the first or second cavities.

* * * * *